United States Patent [19]

Yavorsky

[11] 3,987,926

[45] Oct. 26, 1976

[54] BLOW MOLDED CONTAINER

[75] Inventor: William M. Yavorsky, Spartanburg, S.C.

[73] Assignee: Harley Corporation, Spartanburg, S.C.

[22] Filed: July 7, 1975

[21] Appl. No.: 593,648

[52] U.S. Cl. ..... 220/66; 220/74; 220/DIG. 1

[51] Int. Cl.[2] ..... B65D 7/42

[58] Field of Search ..... 220/74, 72, 5 R, 70, 220/66, DIG. 1

[56] References Cited

UNITED STATES PATENTS

| | | | |
|---|---|---|---|
| 3,038,627 | 6/1962 | Daley | 220/70 X |
| 3,279,640 | 10/1966 | Dodson | 220/5 R |
| 3,647,110 | 3/1972 | Hammes | 220/72 |
| 3,940,011 | 2/1976 | Dubois et al. | 220/DIG. 1 X |

*Primary Examiner*—William Price
*Assistant Examiner*—Steven M. Pollard
*Attorney, Agent, or Firm*—Wellington M. Manning, Jr.

[57] ABSTRACT

A blow molded container is described and claimed herein modified to be suitable for improved handling during the use thereof. A container is provided with suitable structural ribs around the girth thereof and having a compression molded lifting tab across a portion of the top of the container. The top of the container surrounding the compression molded lifting tab is preferably provided with directional passageways into the tab area. Suitable bungs, logo plates, lifting grips and the like may also be provided if desired.

9 Claims, 3 Drawing Figures

BLOW MOLDED CONTAINER

BACKGROUND OF THE INVENTION

Blow molded containers have been produced heretofore for wide and various useage. In general, however, the blow molded containers have historically been used for packaging materials for consumer use in one gallon size or less. A lack of large capacity blow molded containers has resulted from a lack of suitable handling means—an inability to manufacture same.

Blow molded containers are produced when a parison of a fluent plastic material is secured in a mold and a blow pin or other means is inserted to propel air under pressure into the inside of the parison, whereby the fluent plastic material of the parison is expanded by the air into conformity with the mold cavities. Once the plastic cools, the shape defined by the cavities is retained and the molded product is produced. Excess plastic material known as flashing is found adjacent the periphery of the mold junctions and is trimmed off automatically or manually to afford the finished unitary container.

Blow molding has provided a capability of production of numerous design variations that were heretofore not feasible with deep draw, injection, or other molding techniques. The use of blow molding is hence quite desirable to enable one to produce a plastic container with a particular shape or configuration without exhorbitant costs. Shape and design could be directed to a hollow handle or some other functional portion of the container or could be directed purely to the aesthetics of the container or a part thereof.

In general, as mentioned above, blow molded containers have been limited as to size from a practical handling standpoint. While large plastic containers, 30 to 50 gallons capacity, for example, were practical based on available machinery and technology, the physical handling of a 30 to 50 gallon container full of a liquid having a similar density to that of water has previously been impractical. Suitable means for manipulating the filled containers during handling were not available. For example, while metal containers have lifting ribs around the girth to receive the tines of a fork lift and be individually handled thereby, such a handling technique for blow molded containers is dangerous due to the pliability of the plastic. The filled container could slip from between the fork lift tines. Likewise, the containers generally are not rigid to the same standard of a metal container whereby it is difficult to pass the tines of a fork lift beneath the container for lifting while balancing the container. Conventional molding techniques dictate the use of radiused corners and edges as opposed to sharply defined corners and edges that may be found on metal containers. The rounded bottom edges of the blow molded containers thus dictate different handling techniques from comparable metal containers.

One or more of the above noted disadvantages found with use of large capacity blow molded containers has generally precluded successful commercialization of same.

The present invention now provides a large capacity container that is capable of being easily handled in a suitable fashion such that the problems of the prior art are obviated. In this regard, the present invention represents an advance in the art, as exemplified by unexpected improvement as will be more particularly defined hereinafter. The prior art is devoid of any teaching or suggestion of the container of the present invention. Exemplary of the prior art are U.S. Pat. No. 2,913,140 to Vuillemenot; U.S. Pat. No. 3,025,947 to Hammer; U.S. Pat. No. 3,180,512 to Moss; U.S. Pat. No. 3,297,350 to Hidding; U.S. Pat. No. 3,308,997 to Kelly; U.S. Pat. No. 3,318,630 to Bryant; U.S. Pat. No. 3,350,132 to Ashton; U.S. Pat. No. 3,369,690 to Hayes; U.S. Pat. No. 3,383,017 to Krings; U.S. Pat. No. 3,581,930 to Gunnink, and U.S. Pat. No. 3,737,069 to Owen.

SUMMARY OF THE INVENTION

It is an object of the present invention to provide an improved large capacity blow molded container.

Another object of the present invention is to provide an improved barrel type blow molded container for handling granular or liquid materials in suitable, safe fashion.

Yet another object of the present invention is to provide a new plastic, blow molded container that may be handled during use in an improved manner.

Generally speaking, the blow molded container of the present invention comprises bottom, top and side walls, said walls defining a unitary container structure, said top wall having a compression molded lift tab integral therewith across at least a portion thereof.

More specifically, the container of the present invention is blow molded and as such, is preferably provided with integral bottom, top and side walls. One end of the container may be omitted in the blowing step and added at the time of filling. The container is generally round similar to a barrel, though many other shapes may be provided if desired. A preferred container according to the teachings of the present invention has a barrel shape with a tapered bottom. A pair of dished out areas located around the circumference of the bottom are preferably provided to receive a hand and thus facilitate manual lifting or tilting of the container. Likewise, along the general height of the container one or more circumferential ribs may be included. As mentioned above, the circumferential ribs are not normally used for lifting the blow molded container with the tines of a fork lift, due to slippage of the container, or the like. Hence, the ribs provide rigidity and strength along the height of the container while at the same time serving as a spacer for placement of adjacent like containers.

The top of the container is generally provided with some means of ingress and egress for the contents of same. Conventional bungs may be employed along with spouts or such other dispensing means as desired. In a preferred embodiment, bungs are disposed along opposite sides of the container in symmetrical fashion. Likewise, adjacent the top of the container, a logo area is provided where a logotype may be molded into the container wall during production of the container. A logotype or other indicia or information pertaining to a customer may be used on an interchangeable insert to customize the container as desired.

A further important aspect of the container according to the present invention is the compression molded lift tab on the top wall. During manufacture, as mentioned above, a parison is positioned between mating mold sections after which the mold sections come together into registry, around the parison. For molding the present container, a portion of the parison is entrapped between appropriate cavities of the mold, above the blow cavities. The parison is then compression molded to form the lift tab simultaneously with blow molding of the remainder of the container. Structural rigidity is thus provided for the lift tab which is solid to permit a suitable clamp or other lifting means to become secured therearound for lifting the filled container. Likewise, the solid lift tab also affords a location for a hand grip for tilting the container, or for use in conjunction with the bottom hand lift areas to lift a container, if size permits.

In a most preferred embodiment, two blow molded raised ribs are provided on the top wall and extend in a direction transverse to the direction of the lift tab. The raised ribs thus cooperate with the lift tab to define an H shape across the top of the container. A dual purpose is served by the raised ribs, in that, they afford additional structural rigidity to the container adjacent the lift tab to permit greater strength for lifting. At the same time a valley is provided between the raised ribs on opposite sides of the lift tab that serves as a guide slot into the lift tab. A fork lift operator can thereby better align the fork lift tines for engagement with a clamp means on the tab by alignment with the valley between the ribs.

DESCRIPTION OF THE PREFERRED EMBODIMENTS

Figure 1:
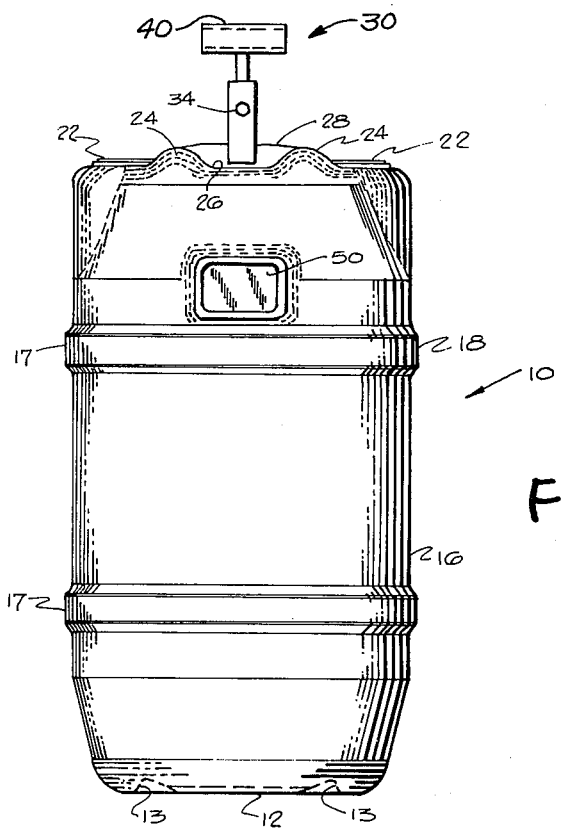
FIG. 1 is a side elevational view of a blow molded container according to the present invention.
Figure 2:
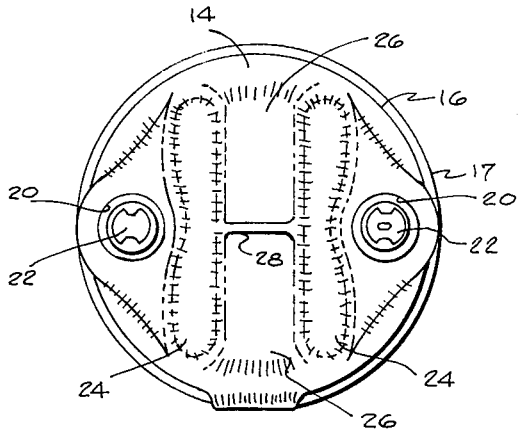
FIG. 2 is a top plan view of a blow molded container according to the teachings of the present invention.

Referring to the Figures, preferred embodiments of the present invention will now be described in detail. FIG. 1 shows a blow molded container generally indicated as 10 having a bottom wall 12, a top wall 14 and a side wall 16. Note that container 10 as illustrated assumes the general appearance and configuration of a barrel where a pair of ribs 17 are provided around the periphery of side wall 16, with ribs 17 providing a lip 18 extending outwardly from side wall 16 in a normal fashion.

Bottom wall 12 is provided with a plurality of dished out sections 13, preferably two, that are located around the circumference of container 10 and taper in depth from the center of the container generally outwardly to define a hand grip for assistance in handling of container 10. Bottom wall 12, as illustrated in the Figures is of unitary construction with side wall 16 and top wall 14. Either bottom wall 12 or top wall 14 could, however, be separate members that are applied at the time of filling as is generally found in the container art.

The top wall 14 of container 10 is provided with a pair of openings 20 having suitable closures 22 provided therein. Closures 22 may be threaded caps, clamps, or the like as desired for proper dispensing for container 10. Additionally, top 14 is preferably provided with a pair of raised ribs 24 that extend in a generally parallel relationship across a major portion of the diameter of top 14. Ribs 24 are radiused on all the edges thereof and define a valley 26 therebetween. Valley 26 extends inwardly from opposite sides of top 14 of container 10 between ribs 24. Intermediate top wall 14 and bisecting ribs 24, is an integral lift tab 28 that has been compression molded during the production of container 10. Lift tab 28 should be of sufficient strength to permit container 10, when filled, to be lifted thereat. As shown in the Figures, lift tab 28 is joined with ribs 24 and cooperates therewith to generally define an H shape on the top of the container. With tab 28 connected to ribs 24, a much greater strength is imparted to the container, thus permitting a larger amount of weight to be handled. Likewise, the thickness of lift tab 28 should be such that a clamp means, for example clamp 30, that is being employed may be easily secured thereto without danger of tearing tab 28, or having the clamp means slip off tab 28. As illustrated in the Figures, lift tab 28 receives the clamp means 30 or the like in suitable engagement to permit lifting of container 10 during handling of same. Further, tab 28 affords a very good appendage to container 10 to hold while tilting or otherwise maneuvering same.

Top wall 14, like bottom wall 12 may be produced separately from container 10 and added at the time of filling. Top wall 14 may, for example, be separately blow molded and added to container 10 by spin welding after the container 10 is filled. Such a procedure still permits the improved handling as described herein for container 10.

Figure 3:
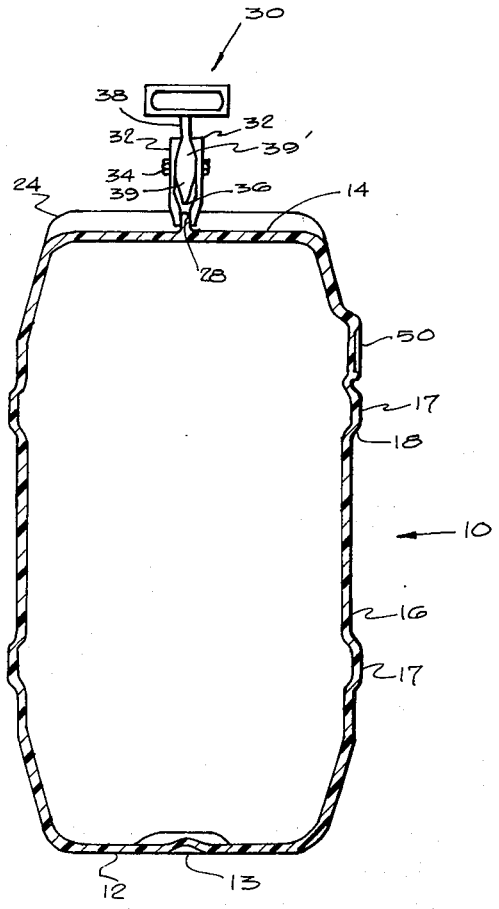
FIG. 3 is a vertical cross sectional view of the container of FIG. 1 taken along a line III—III therethrough.

While clamp 30 does not form a part of the present invention, a suitable type clamp is generically described as follows. In one embodiment, clamp means 30 as illustrated more particularly in cross section in FIG. 3, comprises a pair of jaws 32 that are secured in loose fashion by a bolt or the like 34 and have a shaped cavity 36 defined therebetween. A rod 38 is located between a portion of jaws 32 and a member 39 of like shape as cavity 36 is affixed thereto. A hollow bracket member 40 is secured atop rod element 38 and is designed to receive a tine of a fork lift or any other suitable lifting member therein. When lifting of container 10 is desired, jaws 32 of clamp 30 are placed over lift tab 28 and an upward force is applied onto element 38 via tubular member 40. The upward movement causes member 39 to move upwardly. Beveled edges 39' of member 39 engage like shaped portions of the inside cavities of jaws 32. Jaws 32 are thereby pivoted outwardly about bolt 34 at an upper end while the lower end of jaws 32 that are received around lift tab 28 pinch inwardly against lift tab 28 to produce a tight friction fit therearound. Thereafter, so long as the force remains on bracket 40, the lower end of jaws 32 will continue to pinch lift tab 28 and securely hold container 10, up to the point of rupture of the material from which lift tab 28 is made. While container 10 is filled, the container weight per se will produce the necessary force on bracket 40 to securely hold clamp 30 on lift tab 28. In a reverse fashion, downward movement of the tines of the fork lift, or the like will force element 39' downwardly and in so doing will bias the lower end of jaws 32 outwardly, out of holding engagement with lift tab 28. Clamp 30 can then be reused on further containers.

A further feature of the present invention that is of particular interest to customers is the means to customize each container. A logo area 50 is provided in the container mold. An insert (not shown) can be included to mold a customer's logo, into the side of container 10 at logo area 50. Likewise, Department of Transportation information, gross weight, or the like may be molded in situ into the container side wall. The in situ molding of the desired indicia into side wall 16 of container 10 permanently identifies container 10 according to the indicia. Such identification can be helpful in better controlling return of the containers for recyle, reuse, or the like.

In the manufacture of blow molded containers, as mentioned above, a fluent plastic parison is employed. The plastic conventionally used in the industry may likewise be used in producing the containers of the present invention, so long as strength characteristics permit same. Also, while different colors, plastic compositions and the like may be employed, high molecular weight polyethylene is a preferred material for making the preferred one piece containers of the present invention. Design is also unlimited so long as the requisite features of the container are included.

Having described the present invention in detail, it is obvious that one skilled in the art will be able to make variations and modifications thereto without departing from the scope of the invention. Accordingly, the scope of the present invention should be determined only by the claims appended hereto.

What is claimed is:

1. A blow molded container comprising a bottom wall, a top wall and a side wall, said top wall having at least one dispensing opening therein, said at least one opening being defined by said top wall and a projection extending upwardly from said top wall, said projection being otherwise unattached and having a closure member removeably received therein, said top wall further having a pair of spaced apart raised ribs thereon and of unitary construction therewith, said ribs defining a valley therebetween, and a solid member located between said ribs and being of unitary construction with said ribs and said valley defined therebetween, said solid member being uninterrupted therealong and terminating at said ribs.

2. A blow molded container as defined in claim 1 wherein said solid member is transverse to the long dimension of said ribs.

3. The blow molded container as defined in claim 1 wherein said lift tab is compression molded.

4. The blow molded container as defined in claim 1 further comprising a bottom wall integral with said side wall.

5. The blow molded container as defined in claim 4 wherein said bottom wall has a plurality of individual, tapered dished out areas therein, whereby handling of said container is facilitated.

6. The blow molded container as defined in claim 1 wherein the top wall is integral with said side wall.

7. The blow molded container as defined in claim 1 wherein an indicia receiving area is provided in said side wall.

8. The blow molded container as defined in claim 1 wherein said top wall further has a plurality of dispensing openings therein.

9. The blow molded container as defined in claim 1 wherein said side wall has a plurality of ribs therearound.

* * * * *